United States Patent [19]

Haas et al.

[11] Patent Number: 4,858,745

[45] Date of Patent: Aug. 22, 1989

[54] ESCALATOR STEPS HAVING LATERAL SAFETY DEVICES

[76] Inventors: Max Haas, Lopperstr. 8, CH-6010 Kriens; Joris Schroder, Schadrutihalde 2, CH-6006 Luzern, both of Switzerland

[21] Appl. No.: 212,896

[22] Filed: Jun. 30, 1988

[30] Foreign Application Priority Data

Jul. 1, 1987 [CH] Switzerland ..... 02490878

[51] Int. Cl.[4] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 3,986,595 | 10/1976 | Asano et al. | 198/333 |
| 4,362,232 | 12/1982 | Saito et al. | 198/333 |
| 4,374,558 | 2/1983 | Saito | 198/333 |
| 4,397,383 | 8/1983 | James | 198/333 |
| 4,413,719 | 11/1983 | White | 198/333 |
| 4,570,781 | 2/1986 | Kappenhagen | 198/333 |

FOREIGN PATENT DOCUMENTS

| | | | |
|---|---|---|---|
| 1144508 | 4/1983 | Canada | 198/333 |
| 0041378 | 3/1977 | Japan | 198/333 |
| 0061092 | 5/1977 | Japan | 198/333 |

*Primary Examiner*—Frank E. Werner
*Assistant Examiner*—D. Glenn Dayoan

[57] ABSTRACT

A safety device for the side edges of every escalator step tread plate and riser is formed of an elastic synthetic material of a very low coefficient of friction. All ribs on the body of the safety device are supported tiltably such that under loading the outermost safety rib touches the handrail base and closes the air gap between the step and the base. The tilting is controlled by a wedge-shaped recess formed in the body. The recess is closed toward the air gap by either an inwardly arched terminating wall or by a flange.

16 Claims, 3 Drawing Sheets

ESCALATOR STEPS HAVING LATERAL SAFETY DEVICES

BACKGROUND OF THE INVENTION

The invention generally relates to an escalator and, in particular to an escalator with a traveling step conveyor guided between two bases for handrails and having steps with lateral safety devices.

In order to protect against the known latent danger of drawing-in or catching of light articles of clothing and light footwear between the traveling steps and the solidly attached lateral bases on escalators, various safety devices attached laterally on the steps have become known. The choice of such safety devices goes from simple color marking of the danger zone to complicated barriers laterally insertable on the steps.

A safety device for escalators includes, on both sides of each individual step, a protruding insert of synthetic material received in the furtherst sideward groove on the upper surface of the step as shown in the U.S. Pat. No. 4,397,383. The insert is produced by the extrusion process and has two flanges. For mounting on the surface of the step, the first flange is pressed into the outermost groove of the step. The second flange, protruding opposite the contact surface of the step, is supported towards the stepping side and is tiltable against the fixed base. In the unloaded condition, the protruding flange turns towards the base, without touching the same, and forms a clearance between the flange and the base, which is approximately equal to the clearance between the outermost solidly attached rib of the step and the base. If the flange is stepped upon by the shoe of a passenger, it bends towards the base, whereby the clearance between the base and the safety insert is closed. The protruding flange of the safety insert, which has the lowest possible coefficient of friction, glides on the base and prevents articles of clothing or light footwear of the passenger from being clamped between the step tread plate and the base and being pulled inward. An article, which in spite of this is eventually pulled between the synthetic material insert and the base, can be freed again with relative ease from the restraint due to the elasticity of the insert. An immediate application of a counterforce, if the restrained article has not been caught already by the solid edge of the step thread plate is required.

A drawback of this embodiment is that the open gap between the outermost tread plate rib and the safety insert, in particular the undercut between the protruding flange and the clamped flange of the safety insert, can become clogged with dirt in the course of time. Thereby the efficiency of the protruding flange is at least seriously restricted. This drawback has its effect increased in outdoor or open air installations or in installations in underpasses, where the dirt sediment can be extremely heavy, depending on the weather and the time of year. A further drawback lies also in the fact that the mounting of the synthetic material insert in the groove of a cast tread step with conically downward tapered cross-section and also due to the desirable low coefficient of friction of the material of the insert, allows the insert to easily be torn out of the groove. In spite of this safety device on the step tread plate, there exists a further latent possibility of catching and pulling-in of light footwear between the step risers and the base, above all in the upper and in the lower region of the escalator, at points where during the formation of the stair landings or the horizontal runs of the steps, relative movements become necessary between two adjacent step bodies.

A further protective device for escalator steps is disclosed in U.S. Pat. No. 4,570,781 in which protective inserts are arranged on the side edges of the tread plate and on the risers. The protective insert is made of elastic synthetic material by the extrusion process and, in one embodiment, is bolted onto the recessed edge section of the tread plate of the riser from the visible side, or in another embodiment clamped onto the outermost rib of a typical step. The protective insert of the first type has three ribs, where the outermost rib extends above all the other rib surfaces lying on a common plane. The tread of the outermost rib is set at an angle with respect to the other ribs and the bottom of this rib exhibits along the whole length a wedge shaped notch directed towards the base through which the entire rib can be moved with relatively light pressure towards the base or away from the base. The surfaces of the notch lying on top of each other serve as an end stop for the movement of the rib, simultaneously with the contact of the upper edge of the rib on the base. Serving as stop for the movement of the outermost rib, away from the base, is the upper edge of the second rib.

A drawback of this protective device lies in the fact that the notch, which is open towards the base, can likewise get clogged with dirt and thereby the possibility of movement toward the base is impaired or totally prevented. In the extreme case, the outermost rib could even be distant from the base, so that the space between the rib and the base sheet could increase in a wedge-shape and the danger of pulling-in would become greater rather than smaller. The protective device will only respond when the outermost rib is stepped upon or is loaded.

SUMMARY OF THE INVENTION

The present invention is based on the problem of providing a safety device for the lateral edge sections of the steps of an escalator, which responds when stepped upon or upon loading of a part of this safety device by closing the air gap between the respective step and the handrail base. Contamination on the steps exerts no influence on the satisfactory operation of the safety device and in which clothing articles drawn between the step and base can be pulled out again from this position without great effort.

The present invention concerns a safety device installed on the side edges of each tread plate and each riser of an escalator step. The safety device is formed of an elastic synthetic material formed with alternating ribs and grooves extending in the direction of travel. A safety rib is formed adjacent an air gap between the step and a fixed handrail base. A wedge shaped recess formed in the body of the safety device is closed toward the base by either an inwardly arched wall or a closure flange. The recess permits the upper portion of the safety device body to tilt until the safety rib contacts the base to close the gap.

The advantages obtained by the invention can be seen essentially in the fact that the dangerous air gap closes itself in response to treading upon or loading of the danger zone of the tread plate or the riser, and that the movement necessary for the closing of the air gap cannot be influenced by dirt sediment, and further that clothing articles drawn between the base and the lateral safety device can be pulled out with relatively little force due to the elasticity of the safety device. A further advantage of the invention is that the air gap between the step and the base is closed only in case of danger and the lateral safety devices do not brush continuously against the bases, whereby the driving power and the noise generation would be increased.

DESCRIPTION OF THE PREFERRED EMBODIMENT

Figure 1:
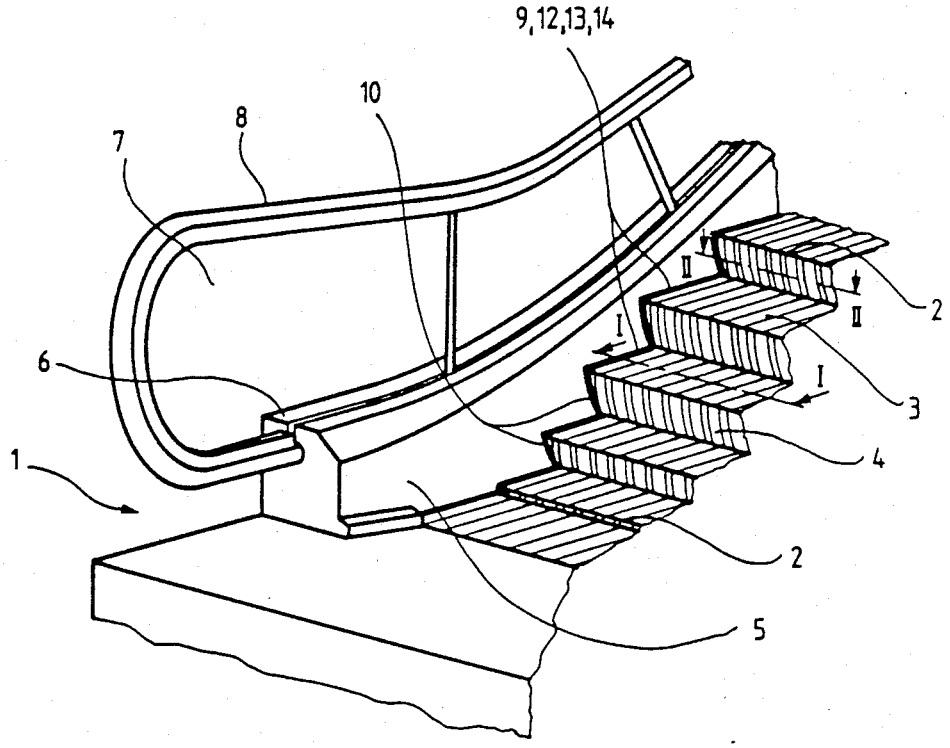
FIG. 1 is a fragmentary perspective view of an escalator including steps with safety devices arranged on their side edges in accordance with the present invention.

Shown in FIG. 1 is a portion of an escalator 1 in the region of the lower first step. The escalator 1 includes a number of steps 2, which steps are positioned as an endless circulating conveyor ribbon between two bases 5 (only one is shown). Each base 5 has formed therein an upwardly facing parapet socket 6. Installed on each parapet socket 6 is a parapet 7, on which an endless rubber handrail 8 runs synchronously with the step conveyor ribbon. Each step 2 includes a generally horizontally extending tread plate 3 and a generally vertically extending riser 4. On each side of the tread plate 3, safety devices 9, 12, 13 or 14 are provided as a termination towards the base 5. In an identical manner, similar safety devices 10 are arranged on each side of the risers 4.

Figure 2:
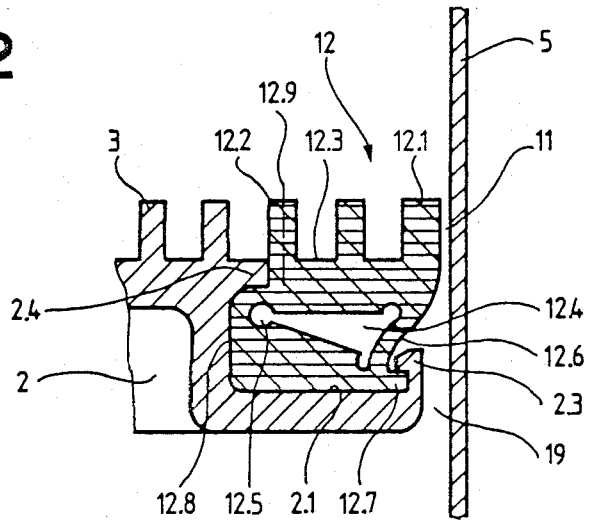
FIG. 2 is an enlarged cross-sectional view, as if taken along line I—I of FIG. 1, showing the safety device with an inward arched rear closing wall on the tread plate.

The safety device 12 is shown enlarged and in cross-section in FIG. 2. The device 12 includes ribs 12.2 and a safety rib 12.1 spaced by an air gap 11 from the base 5. The ribs are the same height as the ribs on the tread plate 3 and define grooves 12.3 therebetween. A wedge-shaped recess 12.4, with an axis of rotation 12.5, is formed in the body of the device 12. The axis of rotation 12.5 lies between a plane defined by a side surface 12.8 adjacent the tread plate 3 and a parallel plane extending through a central axis 12.9 of the rib 12.2 closest to the side surface 12.8. A closure in the form of an inwardly arcuate terminating side wall 12.6 closes the wedge-shaped recess 12.4 adjacent to the base 5. the body of the step 2 has a receiving recess with a shoulder 2.4 formed at the edge of the upper surface of the tread plate 3 and a lug 2.3 formed at the edge of the lower surface adjacent to the base 5 for clamping the safety device 12 on the step with the aid of a flange 12.7 formed on a lower edge of the device 12. An enlarged air gap 19 is created between the base 5 and the fixed part of the step 2 below the air gap 11.

Figure 3:
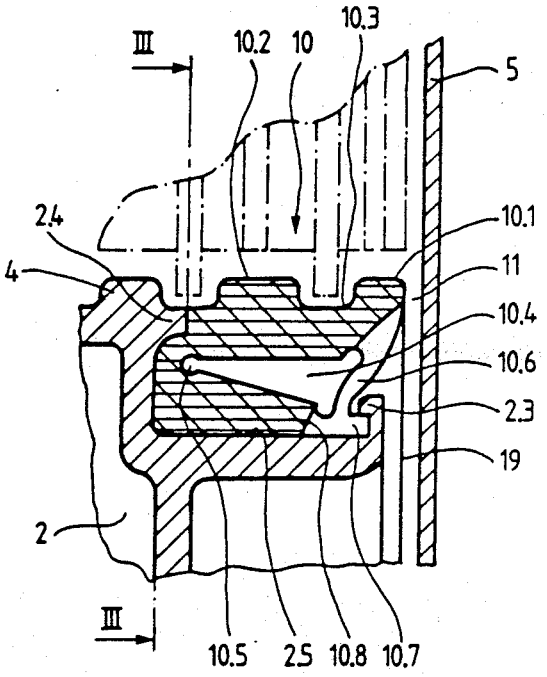
FIG. 3 is an enlarged cross-sectional view, as if taken along the line II—II of FIG. 1, showing the safety device arranged on the risers.
Figure 4:
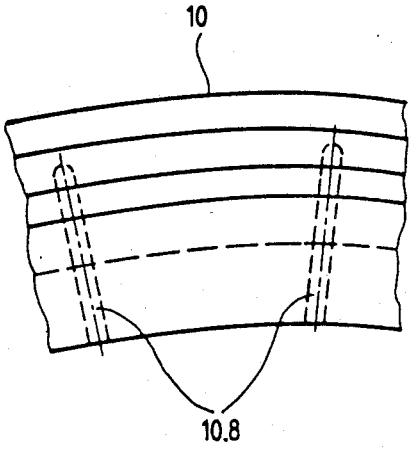
FIG. 4 is a cross-sectional view taken along the line III—III in FIG. 3 showing the safety device on the risers.
Figure 5:
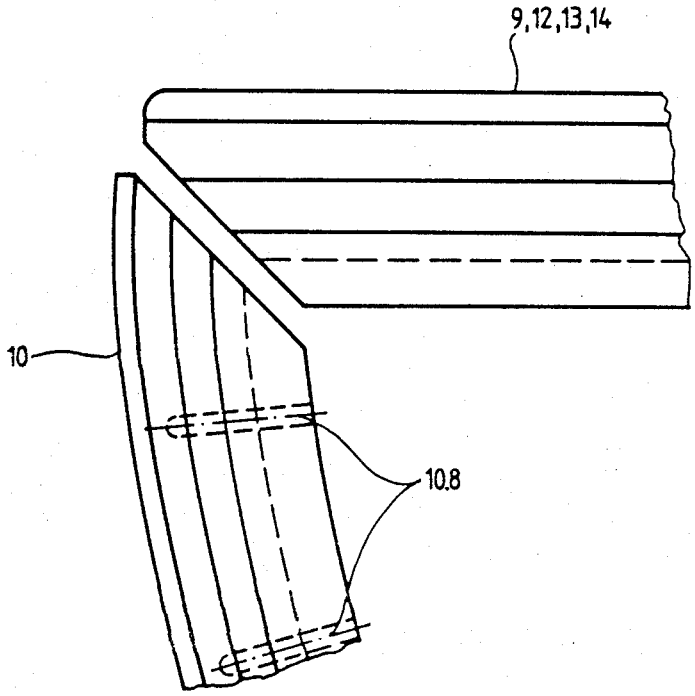
FIG. 5 is a side elevational view of the leading edge of a step in the region of the connection of the safety devices on the tread plate and on the riser.

In the FIGS. 3, 4 and 5, the safety devices 10, which are arranged on both side edges of the slightly convexly arcuate riser 4, are shown. The safety devices 10 include an upstanding rib 10.2 as well as a safety rib 10.1 spaced by the air gap 11 from the base 5. A groove 10.3 is defined between the ribs 10.1 and 10.2. The safety device 10 is inserted into a receiving recess 2.5, which is formed in the arch of the riser 4, and clamped fast with the aid of the shoulder 2.4 and a terminal flange 10.7 cooperating with the lug 2.3 of the body of the step 2. A wedge-shaped recess 10.4 with an axis of rotation 10.5 is formed in the interior of the safety device 10. the wedge-shaped recess 10.4 is covered on the side towards the base 5 by an inwardly arched terminating closure or wall 10.6. Formed between the base 5 and the solid part of the step is the enlarged air gap 19. In order to obtain a greater pliability or flexibility of the safety device 10, a number of slots 10.8 are provided in the terminating wall 10.6.

Figure 6:
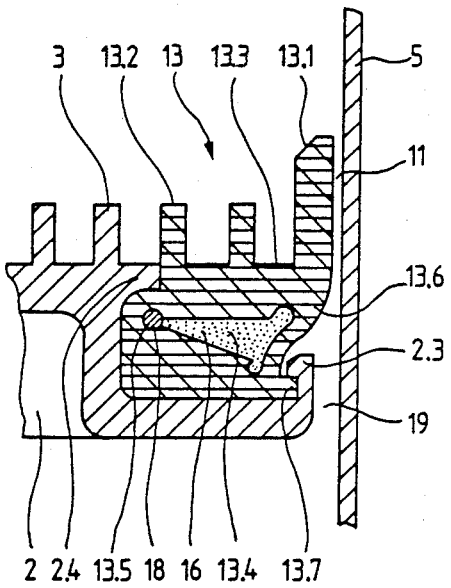
FIG. 6 is a cross-sectional view similar to FIG. 2 of an alternate embodiment in which the wedge-shaped recess of the safety device is filled with a compressible, foamed mass of synthetic material.

Further embodiments of the safety device according to the present invention are presented in the FIGS. 6, 7, 8 and 9. In FIG. 6, the safety device is designated with 13. It includes ribs 13.2, grooves 13.3 and a safety rib 13.1, which is protruding with respect to the other ribs 13.2 and is separated from the base 5 by the air gap 11. A wedge-shaped recess 13.4 is provided in the interior of the safety device 13 with an axis of rotation 13.5 and is filled with a foamable synthetic material 16, in order to increase the spring action of the safety device 13. Into the recess at the axis of rotation 13.5, an appropriate stabilizing pin 18 can also be inserted, which fills this recess and keeps the stroke in the region of the axis of rotation small when loaded. The back side closure of the wedge-shaped recess 13.4 forms an inwardly arched terminating wall 13.6. The safety device 13 is held with the aid or a terminal flange 13.7 cooperating with the shoulder 2.4 and the lug 2.3 of the body of the step 2. Located between the lug 2.3 of the body of step 2 and the base 5 is the enlarged air gap 19.

Figure 7:
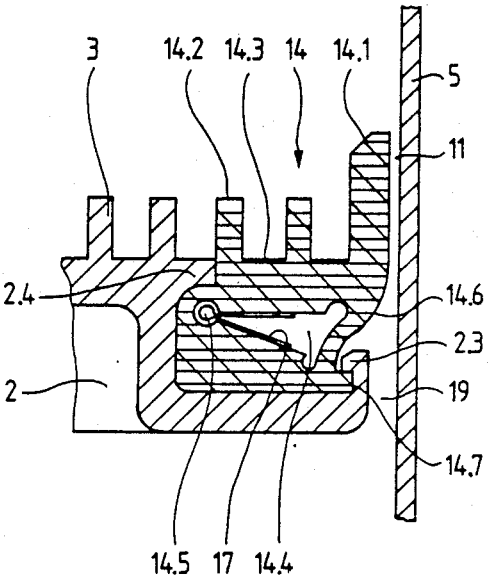
FIG. 7 is a cross-sectional view similar to FIG. 2 of a second alternate embodiment in which leaf springs are inserted in the wedge-shaped recess of the safety device.

In FIG. 7, a second alternate embodiment safety device is designated with 14. It includes ribs 14.2, grooves 14.3 and a safety rib 14.1 protruding above the remaining ribs 14.2 and separated by the air gap 11 from the base 5. Into a wedge-shaped recess 14.4 provided in the interior of the safety device 14 with an axis of rotation 14.5, one or more leaf springs 17 are inserted for increasing the initial stressing force. The back side closure of the wedge-shaped recess 14.4 forms again an inwardly arched closure wall 14.6. The safety device 14 is held with the aid of the shoulder 2.4 and a terminal flange 14.7 cooperating with the lug 2.3 of the body of the step 2. The air gap formed between the lug 2.3 and the base 5 is designated with the number 19.

Figure 8:
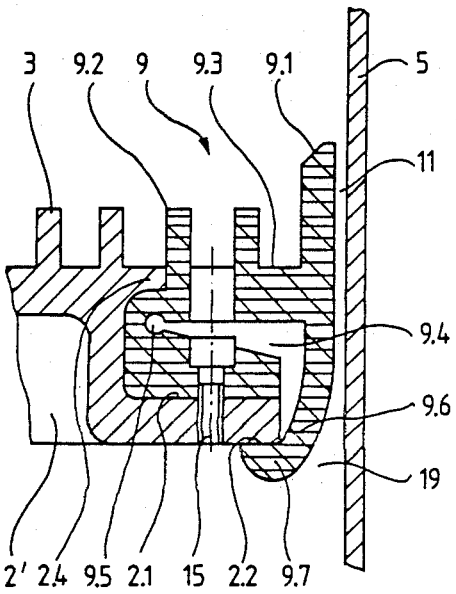
FIG. 8 is cross-sectional view similar to FIG. 2 of a third alternate embodiment in which the safety device is bolted on the tread plate.

A third alternate embodiment safety device 9 is presented in FIG. 8, with ribs 9.2, grooves 9.3 and a safety rib 9.1 spaced by the air gap 11 from the base 5 and protruding above the remaining ribs 9.2. The safety device 9 is placed in a receiving recess 2.1 of a step 2' and solidly attached by bolts 15. A wedge-shaped recess 9.4 with an axis of rotation 9.5 is provided in the interior of the safety device 9. To provide an initial stressing force, a downwardly extending closure in the form of a flange 9.6 of the safety device 9 has a terminal flange 9.7 which engages a stop 2.2 formed on the bottom surface of the body of the step 2' in place of the lug 2.3 and covers the wedge-shaped recess 9.4 towards the base sheet 5. An enlarged air gap formed between the closure flange 9.6 and the base 5, is again designated with the number 19.

Figure 9:
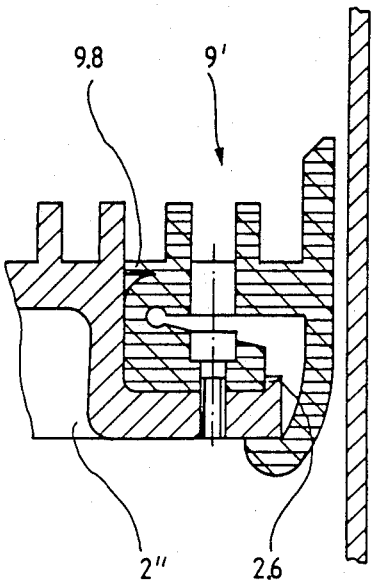
FIG. 9 is a cross-sectional view similar to FIG. 2 of a fourth alternate embodiment in which the safety device is bolted on the tread plate and can be easily exchanged.

Presented in FIG. 9 is a fourth alternate embodiment safety device 9' similar to the device 9 in FIG. 8, which for easier exchange ability includes an upper flange 9.8 in place of the upper shoulder 2.4 on the body of the step 2'. In addition, a guide stop 2.6 is provided on the body of a step 2" in place of the lug 2.3 to engage the device 9'.

The devices described above function in the following manner: The safety devices 9 (9', 12, 13 and 14) arranged laterally on the step tread plates 3 and the safety devices 10 on the risers 4 are made of an elastic synthetic material by the extrusion process. They are inserted in suitable receiving recesses 2.1 and 2.5 on the body of the steps 2 (2', 2") and either held tight by shoulders 2.4 and lugs 2.3 or attached by the bolts 15. The safety devices 9 (9', 10, 12, 13 and 14) include an interior wedge-shaped recess 9.4 (10.4, 12.4, 13.4 and 14.4) which allows the upper accessible load carrying portion of the safety device, in the corner between the base and the riser, to tilt. Depending on the choice of the material, it is possible to obtain the necessary spring action by the material itself, or by inserts in the shape of springs 17, foamed synthetic material 16, etc. The wedge-shaped recess 9.4 (10.4, 12.4, 13.4 and 14.4) is either completely closed toward the base by a terminating wall 12.6, 13.6, 14.6 or covered by a flange 9.6. The deposition of dirt in the recess is thereby practically excluded and the capability as to the tilting movement is not impaired.

Upon stepping onto an upper surface of the safety device 9 (12, 13 and 14), a portion tilts downwardly toward the back of the step, and about the axis of rotation 9.5 (10.5, 12.5, 13.5 and 14.5) of the wedge-shaped recess 9.4 (10.4, 12.4, 13.4 and 14.4). So that the axis of rotation 9.5 (10.5, 12.5 and 13.5) can maintain its position as far as possible on loading, one or several stabilizing pins 18 can be pushed into the corresponding recess. In the tilting movement, the protruding safety rib 9.1 (10.1, 13.1 and 14.1) formed on the edge, comes to rest on the base 5, while the air gap 11 between the base 5 and the safety device 9 (10, 12, 13 and 14) closes. The pulling in or an article of clothing of a passenger can thereby be largely prevented. By an appropriate design of the wedge-shaped recess, the tilting path of the safety device is limited as the safety rib lies against the base and as the air gap is closed. This measure prevents, together with the very small coefficient of friction of the material of the safety device, an excessive friction and an excessive heating between the safety rib and the base. The inward arched terminating wall of the wedge-shaped recess makes it possible for the safety device to carry out a downward tilting movement, without bulging against the base. An upward tilting movement is prevented by the terminating wall 12.6, 13.6 and 14.6 which ties together solidly the tread side with the holding side of the safety device.

In the embodiment according to the FIGS. 8 and 9, with the closure flange 9.6 as a cover between the wedge-shaped recess 9.4 and the base 5, an initial stress, created by the material of the safety device 9 itself, is provided, through which the terminal flange 9.7 of the closure flange 9.6 abuts the stop 2.2 of the body of the step. It is possible to increase the initial stress even further, by insertion of a leaf spring 17, as it is presented in FIG. 7. At the tilting movement, that is, at the loading of one of the ribs 9.2 and 9.1 of the safety device 9, the closure flange 9.6 is pressed downward, and in doing so it leaves the stop 2.2 of the body of step 2'. The safety rib 9.1 closes the air gap 11 toward the base 5, while the upper and lower walls of the wedge-shaped recess 9.4 abut and limit the tilting movement in the downward direction. On removal of the load, the safety device 9 again returns to its original position, until the terminal flange 9.7 again abuts the stop 2.2

The air gap 11 between the base 5 and the safety device 9 (10, 12, 13 and 14) is moreover always smaller than the air gap 19 between the base 5 and the body of the step 2. Parts of clothing or shoes of passengers pulled-in in spite of this between the base 5 and the safety device 9 (10, 12, 13 and 14) can be freed again without great effort from this position, on immediate reaction by the elasticity of the safety device 9 (10, 12, 13 and 14) because a further pulling-in of these parts between the base and the solid part of a step is delayed on account of the greater air gap 19.

Not illutrated frontal stops prevent the pushing out of the clamped safety devices in the direction of travel of the steps and prevent at the same time the penetration of dirt into the wedge-shaped recess from the frontal side of the safety devices.

It is contemplated, that on the safety devices which are fastened with screws, the necessary through bores for the heads of the screws are closed with synthetic material plugs in order to prevent the penetration of dirt into the wedge-shaped recesses. It is also possible to provide, in the safety devices 10 and 12 presented in the FIGS. 2 and 3 and described in the preceding text, safety ribs 12.1 and 10.1 which exceed the height of the remaining ribs 12.2 and 10.2, such as the safety ribs 9.1, 13.1 and 14.1 which extend above the remaining ribs 9.2, 13.2 and 14.2 by a certain distance.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. In an escalator having a movable step in a longitudinal direction of travel guided between two handrail bases, the steps including safety devices at each lateral side thereof, where the safety devices are formed of elastic synthetic material and exhibit in the direction of travel ribs and grooves, the safety devices forming a visible termination at lateral edge zones of the steps and each safety device having one of the ribs formed as a safety rib spaced from the adjacent base to form an air gap, each of the safety ribs being movably supported under load to close the air gap between the step and the adjacent base, the improvement comprising:

a wedge-shaped recess formed in the body of each safety device which extends beneath the ribs including the safety rib and is closed adjacent to the adjacent handrail base, and means for retaining the safety device in position forming the air gap, a portion of the safety device being movable by stepping on or loading into a safety position closing the air gap between the step and the adjacent base.

2. The improvement in an escalator according to claim 1 wherein the height of the safety rib adjacent to the adjacent base exceeds the height of the remaining ribs.

3. The improvement in an escalator according to claim 1 wherein said wedge-shaped recess includes a portion defining an axis of rotation positioned between a plane formed by a side surface of the safety device body adjacent the side of the step and a parallel plane extending through a central axis of a one of the ribs spaced closest to said side surface of the safety device.

4. The improvement in an escalator according to claim 1 wherein said wedge-shaped recess is closed adjacent to the adjacent base by an inwardly arched wall formed on the body of the safety device.

5. The improvement in an escalator according to claim 1 wherein when each said safety device is in said safety position recess lie on top of each other.

6. The improvement in an escalator according to claim 1 wherein said wedge-shaped recess is closed adjacent to the adjacent base by a closure flange formed on the body of the safety device engaging a stop on the body of the step through an initial stressing force and a terminal flange.

7. The improvement in an escalator according to claim 1 wherein said retaining means of said wedge-shaped recess includes a foamed, elastic mass of synthetic material positioned in said wedge-shaped recess for increasing the spring action of said movable portion.

8. The improvement in an escalator according to claim 1 wherein said retaining means of said wedge-shaped recess includes a leaf spring positioned in said wedgeshaped recess for increasing the initial stressing force required to move said movable portion.

9. The improvement in an escalator according to claim 1 wherein said retaining means of said wedge-shaped recess includes a stabilizing pin positioned in a receiving recess extending along an axis of rotation of a wall of said wedge-shaped recess for limiting the stroke of movement of said movable portion.

10. The improvement in an escalator according to claim 1 wherein the air gap defined between the safety rib and the adjacent base is always smaller than an air gap defined between the adjacent base and a lower part of the step.

11. The improvement in an escalator according to claim 1 including a second safety device arranged on a riser of the step and including at least one slot facilitating the bending of said second safety device.

12. A safety device for an escalator step having a tread plate and a riser positioned between a pair of handrail bases, comprising:

a body having a plurality of upsanding ribs defining grooves and being formed of an elastic material; a safety rib formed on said body and adapted to be positioned adjacent a handrail base; a wedge-shaped recess formed in said body extending beneath said ribs and said safety rib; and a closure for said recess adjacent said safety rib.

13. The safety device according to claim 12 wherein said closure is an inwardly arched wall of said wedge-shaped recess.

14. The safety device according to claim 12 wherein said closure is a downwardly extending flange.

15. The safety device according to claim 14 wherein said flange includes a terminal flange adapted to engage a stop formed on the step.

16. A safety device for use on the edge of an escalator step positioned between a pair of handrail bases, comprising:

a body formed of a material having a relatively small coefficient of friction;

at least two generally outwardly extending ribs formed on said body defining a groove therebetween, one of said ribs being a safety rib adapted to be positioned adjacent a handrail base to form an air gap betwen the base and the safety device;

a generally wedge-shaped recess formed in said body beneath said ribs and defining an axis of rotation for a portion of said body; and a closure attached to said body and closing said recess, said closure facing said air gap when the safety device is positioned on the edge of an escalator step, whereby a load applied to a portion of said body causes rotation about said axis until said safety rib closes the air gap and engages the base.

* * * * *

UNITED STATES PATENT AND TRADEMARK OFFICE

CERTIFICATE OF CORRECTION

PATENT NO. : 4,858,745

DATED : August 22, 1989

INVENTOR(S) : Max Haas, Joris Schroder

It is certified that error appears in the above-identified patent and that said Letters Patent is hereby corrected as shown below: Add to the first page the following:

"[73] Assignee: Inventio AG, Switzerland"

"Attorney, Agent, or Firm - Marshall & Melhorn"

Signed and Sealed this

Twenty-fifth Day of June, 1991

*Attest:*

HARRY F. MANBECK, JR.

*Attesting Officer*

*Commissioner of Patents and Trademarks*